US005619444A

United States Patent [19]

Agranat et al.

[11] Patent Number: 5,619,444

[45] Date of Patent: Apr. 8, 1997

[54] APPARATUS FOR PERFORMING ANALOG MULTIPLICATION AND ADDITION

[75] Inventors: Aharon Agranat, Mevasseret Zion; Joseph Shafir, Jerusalem, both of Israel

[73] Assignee: Yissum Research Development Company of the Hebrew University of Jerusalem, Jerusalem, Israel

[21] Appl. No.: 263,648

[22] Filed: Jun. 20, 1994

[30] Foreign Application Priority Data

Jun. 20, 1993 [IL] Israel ..... 106067

[51] Int. Cl.[6] ..... G06G 7/16

[52] U.S. Cl. ..... 364/841

[58] Field of Search ..... 364/841, 606

[56] References Cited

U.S. PATENT DOCUMENTS 4,289,035 9/1981 Lee ..... 73/718

4,904,964 2/1990 Peng et al. ..... 332/123

5,008,833 4/1991 Agranat et al. .

5,089,983 2/1992 Chiang ..... 364/841

OTHER PUBLICATIONS

M.A. Holler, "VLSI Implementations of Learning and Memory Systems: A Review", Proceedings of Advances in Neural Information Processing Systems, V 3, Morgan Kaufman Pub., 1991.

*Primary Examiner*—Tan V. Mai

*Attorney, Agent, or Firm*—Stroock & Stroock & Lavan

[57] ABSTRACT

Apparatus for performing analog multiplication of a first value by a second value, including: 1) a variable capacitor whose capacitance represents the first value and 2) a second value voltage receiver, serially connected to the variable capacitor, wherein the second value voltage represents the second value, wherein a voltage level of the variable capacitor resulting from the provision of the second value voltage to the second value voltage receiver represents the multiplication of the first and second values.

16 Claims, 4 Drawing Sheets

40

30

APPARATUS FOR PERFORMING ANALOG MULTIPLICATION AND ADDITION

FIELD OF THE INVENTION

The present invention relates to analog multiplication units generally and to units for performing multiply-accumulate operations in particular.

BACKGROUND OF THE INVENTION

Units performing multiply and accumulate operations, herein known as "multiply-accumulate units", are known in the art. They are particularly useful as subunits of vector-matrix multipliers which, in turn, are elements of neural networks.

An overview of Very Large Scale Integration (VLSI) implementations of neural networks, each implementing a large number of vector-matrix multipliers, is given in the article by Mark A. Holler, "VLSI Implementations of Learning and Memory Systems: A Review", *Proceedings of Ad. VanC in Neural Information Processing Systems,* Vol. 3, Morgan Kaufman Publishers, 1991.

A parallel optoelectronic neural network processor is described in U.S. Pat. No. 5,008,833 to Agranat et al. A matrix W is entered into an array of photosensitive devices which may be charge coupled or charge injection devices. The elements of the matrix W are multiplied by the appropriate vector elements and the results are summed thereby to produce a state vector indicating the state of the neural network.

SUMMARY OF THE INVENTION

The present invention provides a new architecture for a multiply unit which, if desired, can be incorporated into a vector-matrix multiplier operating in a parallel manner.

There is therefore provided, in accordance with a preferred embodiment of the present invention, apparatus for performing analog multiplication of a first value by a second value. The apparatus includes 1) a variable capacitor whose capacitance represents the first value and 2) a second value voltage receiver, serially connected to the variable capacitor, wherein the second value voltage represents the second value. In accordance with the present invention, a voltage level of the variable capacitor resulting from the provision of the second value voltage to the second value voltage receiver represents the multiplication of the first and second values.

There is further provided, in accordance with a preferred embodiment of the present invention, apparatus for performing analog multiplication and addition. The apparatus includes at least two multiplication units, as described hereinabove, for multiplying a first value by a second value wherein each multiplication unit also has a sensor, having first and second ends and connected at the first end to the variable capacitor, operative to sense an output voltage change in a voltage level thereof. The apparatus also includes a summing device connecting in parallel the second ends of at least two of the sensors and operative to sum together the output voltage changes.

There is still further provided, in accordance with an embodiment of the present invention, analog apparatus for multiplying a vector by a matrix. The analog apparatus includes at least two rows of multiply units each for multiplying one row of the matrix by the vector where each multiply unit includes at least two multiplication units for multiplying a matrix element by a vector element, each multiplication unit implemented by the apparatus for performing analog multiplication and addition, described hereinabove.

Additionally, in accordance with an embodiment of the present invention, the second value voltage receiver is a capacitor. The sensor can be either a capacitor or a floating source follower.

Moreover, in accordance with an embodiment of the present invention, the variable capacitor includes a reverse biased diode implemented as a pn junction.

Further, in accordance with an embodiment of the present invention, the variable capacitor is operative to receive a quantity of charge representing the first value.

Still further, in accordance with an embodiment of the present invention, the apparatus includes a charge provider selectably connectable to the pn junction, whereby the charge provider provides the quantity of charge to the pn junction.

Finally, in accordance with an embodiment of the present invention, the capacitance of the variable capacitor is inversely proportional to the first value. However, the quantity of charge is directly proportional to the first value.

BRIEF DESCRIPTION OF THE DRAWINGS

The present invention will be understood and appreciated from the following detailed description, taken in conjunction with the drawings in which.

DETAILED DESCRIPTION OF A PREFERRED EMBODIMENT

Figure 1:
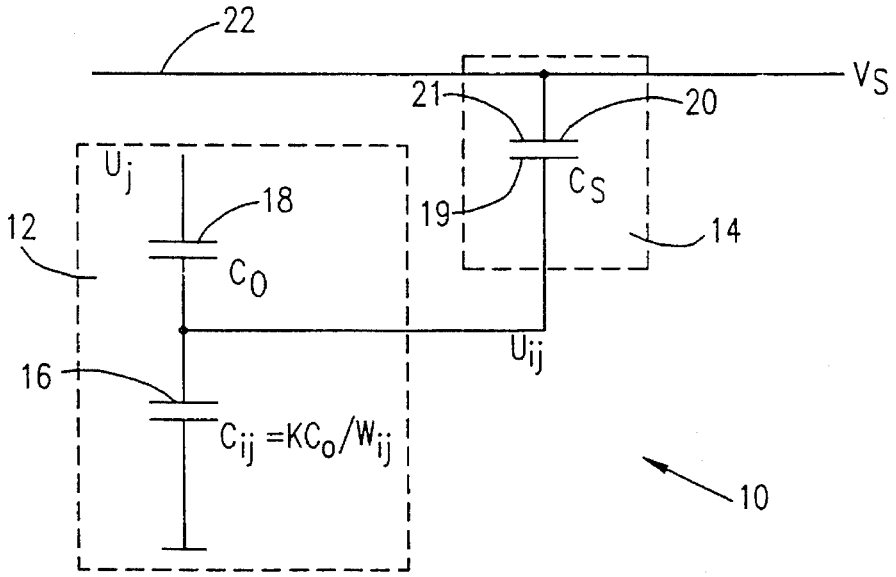
FIG. 1 is an equivalent circuit diagram illustration of a single multiply unit constructed and operative in accordance with an embodiment of the present invention.

Reference is now made to FIG. 1 which illustrates an equivalent circuit for a multiply unit 10, constructed and operative in accordance with an embodiment of the present invention.

Multiply unit 10 comprises a multiply portion 12 for multiplying together a first quantity $W_{ij}$ and a second quantity $U_j$ and an output portion 14 for providing the result of the multiplication to an output sense line 22.

The multiply portion comprises a variable capacitor 16, having a capacitance inversely proportional to the first quantity $W_{ij}$ and a second capacitor 18, having a fixed capacitance $C_o$ and to which is applied an input voltage $U_j$ representing the second quantity.

The variable capacitor 16 can be implemented in a number of ways, for example as a reverse biased diode implemented as a pn junction as detailed hereinbelow with reference to FIG. 3, or as a Metal-Oxide Semiconductor (MOS) capacitor. Typically, and as explained hereinbelow with reference to FIG. 3, the capacitance value is set by storing a charge packet of a desired size in the capacitor 16, where the amount of charge is proportional to the first quantity $W_{ij}$. As shown in FIG. 1, the resultant capacitance of capacitor 16 is proportional to $C_o/W_{ij}$.

The multiply portion 12 is a voltage divider formed of two series capacitors and its output $U_{ij}$ is the voltage change across the variable capacitor 16 which occurs as a result of the applied voltage $U_j$. Assuming that $C_{ij}>>C_o$, the output voltage $U_{ij}$ is:

$$U_{ij}=(C_o/C_{ij})U_j=kW_{ij}U_j \quad (1)$$

Thus, the output voltage of the multiply portion 12 represents the analog multiplication of $W_{ij}$ by $U_j$.

The output portion 14 of each unit 10 comprises an output capacitor 20 having a capacitance $C_s$ which couples the output voltage $U_{ij}$ to the output sense line 22. When a plurality of units 10 are connected together, one port of each output capacitor 20 is connected to the multiply portion 12 of the unit 10 and the other port is connected to the output sense line 22. The total charge on the output sense line 22 is proportional to the sum of the multiply operations performed by the units 10 connected to it.

Figure 4:
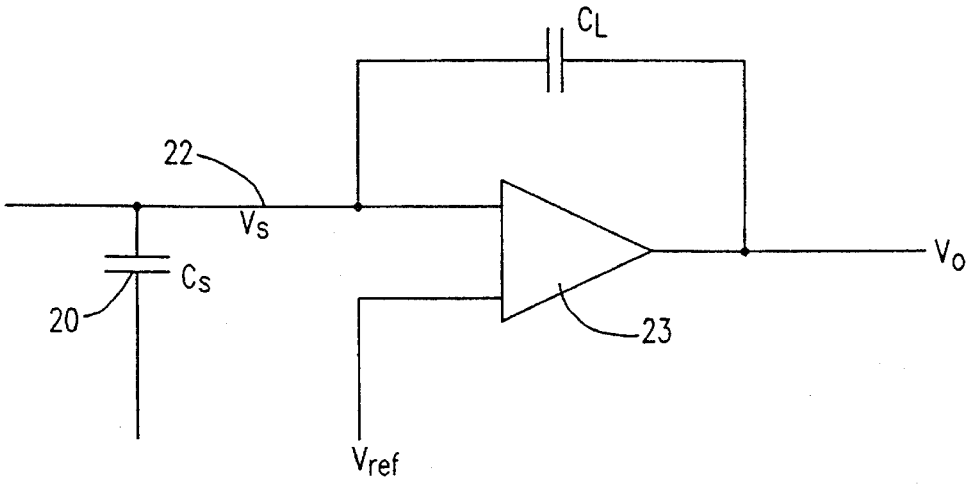
FIG. 4 is a circuit diagram illustration of a unit for maintaining the voltage of an output line fixed and for sensing thereon the output of a plurality of the multiply units of FIG. 3.

In order to ensure that the output charge of one multiply unit 10 does not affect the output charge of another, as shown in FIG. 4 to which reference is now briefly made, the output sense line 22 is optionally connected to an operational amplifier 23. The output voltage of the operational amplifier 23 is then proportional to the total charge accumulated on the output capacitors 20 connected to the output sense line 22.

The multiply unit 10 of the present invention can be a building block in a vector-matrix multiplier 30. A vector-matrix multiplier 30, for example, for multiplying a 2×2 matrix by a 2 element vector, is shown in detail in FIG. 2, to which reference is now made. The vector-matrix multiplier 30 shown in FIG. 2 performs the following operation:

$$\begin{bmatrix} W_{11} & W_{12} \\ W_{21} & W_{22} \end{bmatrix}\begin{bmatrix} U_1 \\ U_2 \end{bmatrix}=\begin{bmatrix} W_{11}U_1+W_{12}U_2 \\ W_{21}U_1+W_{22}U_2 \end{bmatrix} \quad (2)$$

where the matrix elements are implemented as charge packets, the vector elements are implemented as voltage levels and the result appears as accumulated charge on the output sense line 22.

In the vector-matrix multiplier 30, the units 10 are arranged in a matrix fashion. The input voltages of the units 10 in one column are connected to the same voltage, shown in FIG. 2 as $U_1$ and $U_2$, and each output sense line 22 sums the output values of a row of units 10.

It will be appreciated that the vector-matrix multiplier 30 can be operated either synchronously or asynchronously, without any modification. In either case, the input and output vectors are transmitted in and out, respectively, either in parallel (synchronously) or sequentially (asynchronously).

Figure 3:
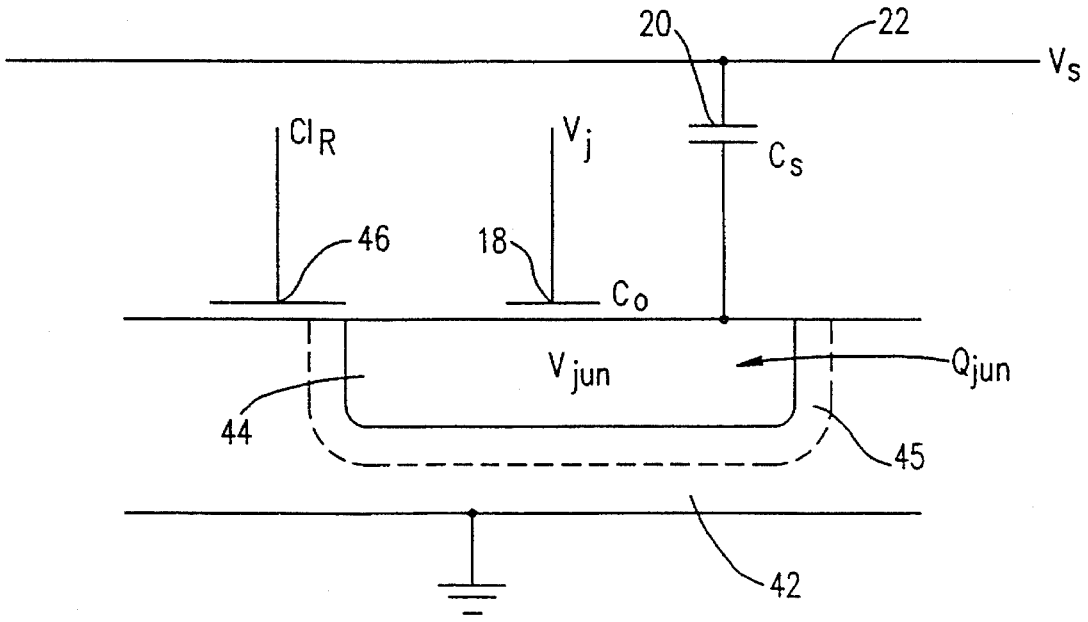
FIG. 3 is a schematic illustration of the implementation of the multiply unit of FIG. 1 as an element of an integrated circuit.

Reference is now made to FIG. 3 which illustrates an implementation of the multiply unit 10 as an element of an integrated circuit where the variable capacitor 16 is implemented as a reverse biased diode formed of a pn junction.

The multiply unit, labeled 40, comprises a silicon substrate 42 in which is formed a pn junction 44 operative to implement the variable capacitor 16. The variable capacitance is the junction small signal capacitance which depends on the reverse bias of the junction. The junction reverse bias voltage, denoted by $V_{jun}$, is a function of the total charge $Q_{jun}$ of a depletion layer 45 of the junction 44.

Second capacitor 18, having capacitance $C_o$, couples an input voltage $V_j$, representing the second value $U_j$, to the junction 44. The output capacitor 20, having capacitance $C_s$, is connected to the junction 44 so as to sense its voltage change. The resultant charge signal on the output capacitor 20 is proportional to the change in the junction voltage which, in turn, is proportional to the multiplication of the applied voltage $V_j$ and the junction depletion layer charge. The junction depletion layer charge is, in turn, set proportional to $W_{ij}$.

In addition, the multiply unit 40 comprises a switch 46, responding to a clock signal $Cl_R$, for controlling the operation of unit 40.

Unit 40 is operated as follows:

a) While $Cl_R$ is set to 0 volts, $V_j$ and $V_s$ are connected to a predetermined voltage.

b) The clock signal $Cl_R$ is raised to open switch 46 thereby enabling the loading of a predetermined amount of charge $Q_{ij}$, proportional to the first value $W_{ij}$ into the junction 44, bringing the junction voltage $V_{jun}$ to $V_{ii}$. As is known in the art, the charge $Q_{ij}$ can be loaded as a charge packet by an external control circuit (not shown) through the application of the appropriate voltage level to the junction 44. Another method of loading charge is described hereinbelow.

c) The clock signal $Cl_R$ is returned to 0 volts to close switch 46 and the output sense line 22 is floated at a voltage $V_s$. As can be seen in FIG. 4, the voltage $V_s$ is maintained constant at a predetermined voltage $V_{ref}$ by the operational amplifier 23.

d) The voltage $V_j$, corresponding to the second value $U_j$, is applied to the column connected to capacitor 18. As explained hereinbelow, the resultant junction voltage change $delta_{13}$ $V_{ij}$ is proportional to the multiplication of the two values $U_j$ and $W_{ij}$, The voltage change in the junction 44 induces a corresponding charge change delta_$Q_s$ on one plate 19 of the output capacitor 20 where the charge change delta_$Q_s$ is also proportional to the multiplication of $U_j$ and $W_{ij}$. The same charge change, but with an opposite sign, appears on the second plate 21 which is connected to the output sense line 22.

Figure 2:
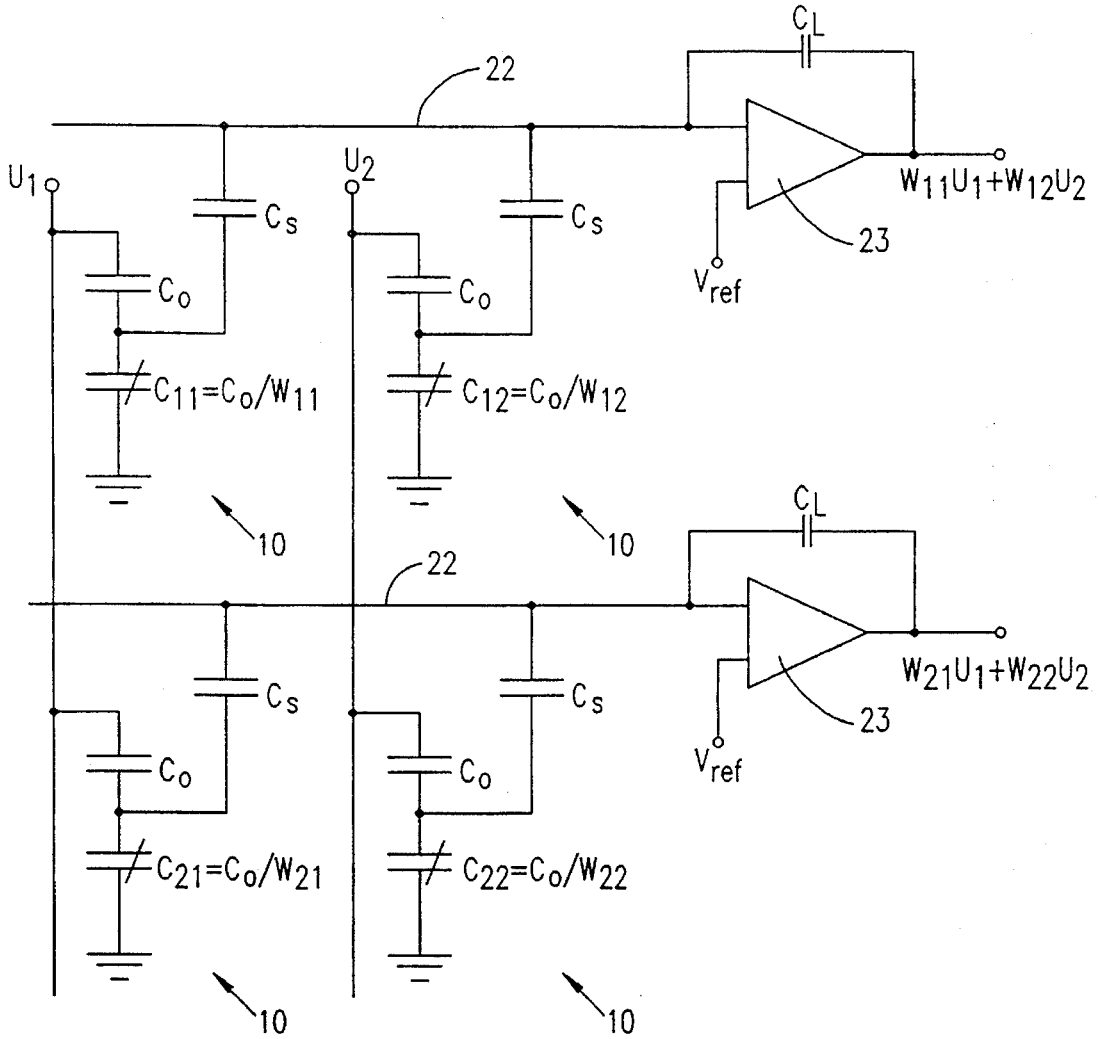
FIG. 2 is a circuit diagram illustration of a multiplicity of the multiply units of FIG. 1 connected together in a parallel fashion to provide vector-matrix multiplication.

Since, as described with respect to FIGS. 1 and 2, many units 40 are attached to the output sense line 22, the resultant total change in the charge on line 22 is proportional to the sum of the multiplications performed in each of the junctions 44 coupled to it. The output voltage change for a line of connected units 40 is consequently proportional to this charge.

When $V_j$ is applied to the capacitor 18, the junction voltage $V_{jun}$, currently at $V_{ii}$, changes by delta_$V_{ij}$ according to the charge equation:

$$C_o(V_j-delta_{13}\ V_{ij})=AqN_A(W-W_o)+C_s delta_V_{ij} \quad (3)$$

where A is the area of junction 44, q is the electron charge, $N_A$ is the dopant concentration of substrate 42, and $W_o$ and W are the initial and final width, respectively, of the depletion layer 45. $W_o$ and W are given by:

$$W_o=[2eps_o eps_s(V_{ij}+V_B)/qN_A]^{1/2} \quad (4)$$

$$W=[2eps_o eps_s(V_{ij}+delta_V_{ij}+V_B)/qN_A]^{1/2} \quad (5)$$

where $eps_o$ and $eps_s$ are the electric permeability constant and the dielectric constant of silicon, respectively and $V_B$ is the "built-in" voltage level of the junction 44.

Since the capacitance of junction 44, $C_{jun}$, is generally set to be much larger than $C_s$, the second term in equation 3, that of $C_s$delta_$V_{ij}$, can be neglected.

Similarly, the capacitance $C_{jun}$ is set to be much larger than $C_o$. As a result, the change delta_$V_{ij}$ in the junction voltage $V_{jun}$ is small and therefore, the change in the width of the depletion layer 45 is small. In accordance with a first order approximation, the term W—$W_o$ can be approximated by:

$$W-W_o=(2eps_s eps_o/[qN_A(V_{ij}+V_B)])^{1/2} delta_V_{ij}/2 \quad (6)$$

Rewriting equation 3 to include the above conditions and approximations produces:

$$C_o(V_j-delta_V_{ij})=(AqN_A\ (2eps_s eps_o/[qN_A(V_{ij}+V_B)])^{1/2} delta_V_{ij}/2 \quad (7)$$

Rearranging equation 7 produces:

$$C_o V_j=\{C_o+A(eps_s eps_o qN_A/[2(V_{ij}+V_B)])^{1/2}\} delta_V_{ij} \quad (8)$$

The second term in the brackets represents the small signal capacitance of the junction 44, $C_{jun}$. Since $C_{jun}$ is much larger than $C_o$, the element $C_o$ in equation 8 can be neglected, thereby simplifying equation 8 to:

$$delta_V_{ij}=\{C_o/A(eps_s eps_o qN_A/[2(V_{ij}+V_B))^{1/2}]\}V_j \quad (9)$$

The charge stored in the depletion layer 45 of junction 44 is given by:

$$Q_{ij}=qN_A AW_o=A(2eps_s eps_o qN_A(V_{ij}+V_B))^{1/2} \quad (10)$$

Substituting equation 10 into equation 9 results in:

$$delta_V_{ij}=[C_o/(A^2 qN_A eps_s eps_o)]Q_{ij}V_j \quad (11)$$

Equation 11 demonstrates that the change delta_$V_{ij}$ in the junction voltage $V_{jun}$, due to the application of $V_j$, is proportional to the product of $V_j$ and the loaded charge $Q_{ij}$.

Since the loaded charge $Q_{ij}$ is proportional to the first value $W_{ij}$, and since the term $[C_o/(A^2 eps_s eps_o qN_A)]$ has a constant value for a given multiply unit, equation 11 can be rewritten as:

$$delta_V_{ij}=\alpha W_{ij}V_j \quad (12)$$

The charge which moves onto the corresponding output capacitor 20 is:

$$Q^s_{ij}=C_s delta_V_{ij=C_s}\alpha W_{ij}V_j \quad (13)$$

The above derivation indicates that, when a charge $Q_{ij}$ proportional to the first value $W_{ij}$ is loaded into the junction depletion layer 45, the change delta_$V_{ij}$ in the junction voltage $V_{jun}$ as a result of applying a voltage $V_j$ is proportional to the multiplication of the first value $W_{ij}$ by the voltage $V_j$ representing the second value $U_j$.

Furthermore, the charging of the output sense line 22 through the output capacitor 20, due to the change delta_$V_{ij}$ of the junction voltage $V_{jun}$, is also proportional to the multiplication $W_{ij}V_{ij}$.

Reference is now made back to FIG. 4. The total charging of the output sense line 22 will be given by:

$$Q_i^s=\sum_j Q^s_{ij}=C_s\alpha\sum_j W_{ij}V_j \quad (14)$$

Each output sense line 22 is connected to the input of the operational amplifier 23 and to a feedback capacitor $C_L$. The resultant output voltage $V_o$ is given by:

$$V_o=Q_i^s/C_L=(C_s/C_L)\alpha\sum_j W_{ij}V_j \quad (15)$$

As can be seen in equation 15, the output voltage $V_o$ is proportional to the sum of a plurality of multiply operations.

In the embodiment described hereinabove, the multiply-accumulate operation is a two-quadrant operation (i.e. while $V_j$ can be either positive or negative, $W_{ij}$, which is represented by the junction depletion layer charge $Q_{ij}$, is of single polarity).

Figure 5:
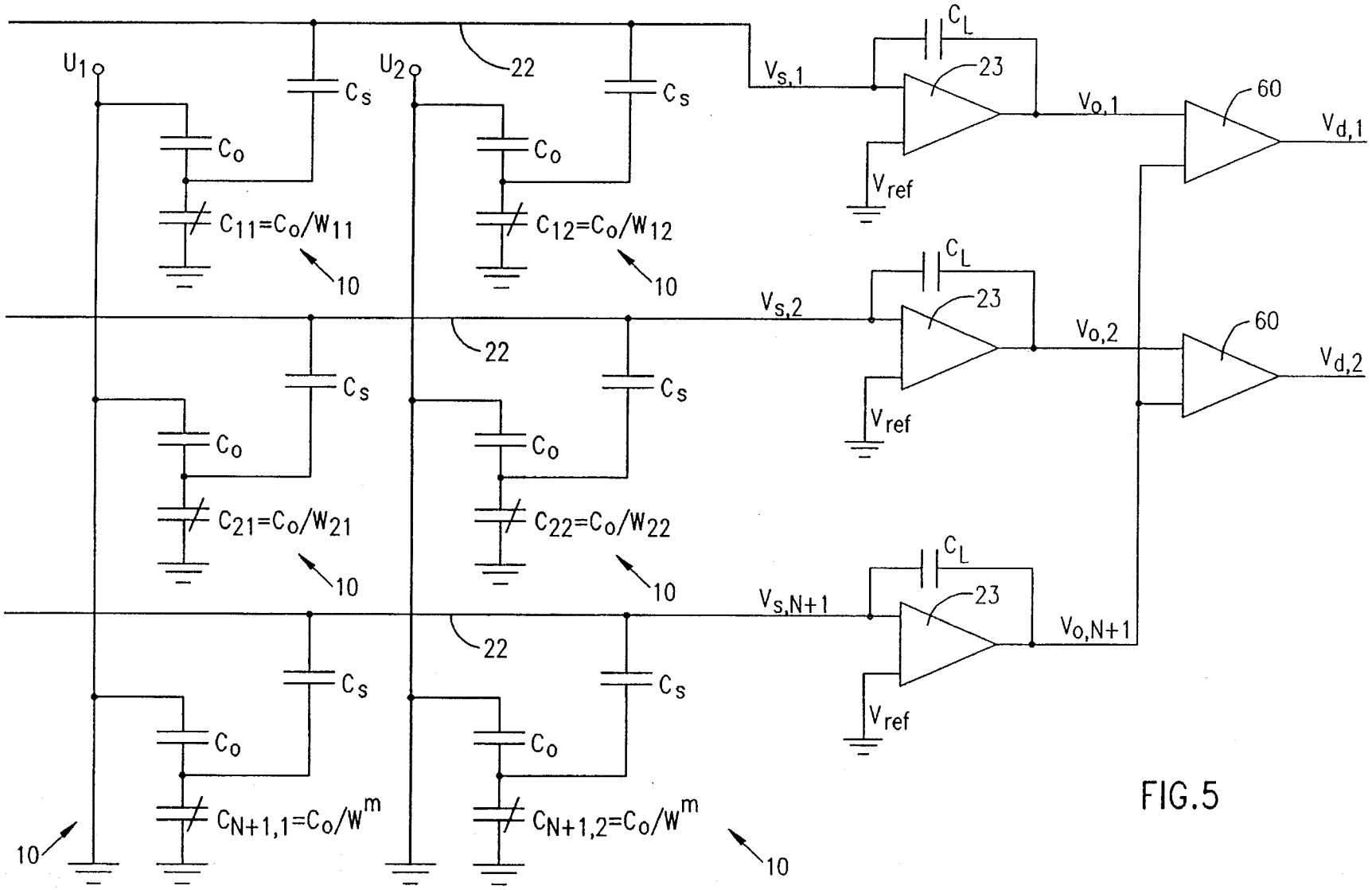
FIG. 5 is a circuit diagram illustration of a multiplicity of the multiply units of FIG. 1 connected together in a parallel fashion to provide four-quadrant vector-matrix multiplication.

In accordance with an alternative four-quadrant embodiment of the present invention shown in FIG. 5, an additional row of cells, numbered the N+1 line, is added. The N+1 row has all the junctions charged to the same medium value of charge $Q^m$ corresponding to an average quantity $W^m$.

In the alternative embodiment, the output voltage $V_o$ of the N+1 line is, according to equations 13–15:

$$V_{o,N+1}=Q^s_{N+1}/C_L=(1/C_L)\sum_j Q^s_{N+1,j}=(C_s/C_L)\alpha\sum_j W^m V_j \quad (16)$$

Each output voltage $V_{o,i}$, i, i=1, , , N, of the operational amplifiers 23 of the N output sense lines 22 is fed into one input of a corresponding differential amplifier 60. The second input of the differential amplifier 60 receives the output voltage $V_{o,N+1}$. The output $V_{d,i}$ of the ith differential amplifier 60 is given as:

$$V_{d,i}=k(V_{o,i}-V_{o,N+1})=k(C_s/C_L)\alpha\left(\sum_j W_{ij}V_j-\sum_j W^m V_j\right) \quad (17)$$

Rearranging the term in brackets produces:

$$V_{d,i}=k(C_s/C_L)\alpha\left(\sum_j (W_{ij}-W^m)V_j\right) \quad (18)$$

Since $W^m$ is an average value within the range of $W_{ij}$, the individual terms of the bracket of equation 18 can be both positive and negative, depending on the individual values of $W_{ij}$.

It will be appreciated that the junction 44 typically has a small leakage current which causes the charge $Q_{ij}$ loaded therein to leak away. Therefore, after a given amount of time, the charge must be refreshed.

The charge $Q_{ij}$ can be loaded into a single junction 44 in accordance with the following method:

a) $V_j$ is set to its reference voltage, typically 0.

b) The output sense line 22 is set to the reference voltage of the operational amplifier 23.

c) The clock signal $Cl_R$ is raised to open switch 46 after which a voltage $V_{ij}^{(o)}$, proportional to $Q_{ij}$, is connected to switch 46.

d) The clock signal $Cl_R$ is returned to 0 volts to close switch 46, thereby connecting voltage $V_{ij}(0)$ to junction 44, and stays closed until the desired $Q_{ij}$ is transferred to the junction 44.

It will be appreciated by persons skilled in the art that the dynamic range of the vector-matrix multiplier 30 is determined by the minimal charge that can be sensed by each output operational amplifier 23.

In principle, the charge supplied to each output sense line 22, as a result of a multiplication operation at a single junction 44, can be increased by increasing the capacitance $C_s$ for that junction 44. This, however, violates the requirement that $C_{jun}$ be much larger than $C_s$, and therefore, renders the above described approach impractical.

Alternatively, it is possible to increase the capacitance of $C_{jun}$. However, this approach currently is costly in 'silicon real estate' (i.e. in space on the integrated circuit chip) and thus, is not an attractive solution.

In an alternative embodiment of the present invention, the dynamic range of the vector-matrix multiplier 30 is increased by adding an amplification stage to each multiply unit 10 which will provide sufficient charge to maintain a high dynamic range.

Figure 6:
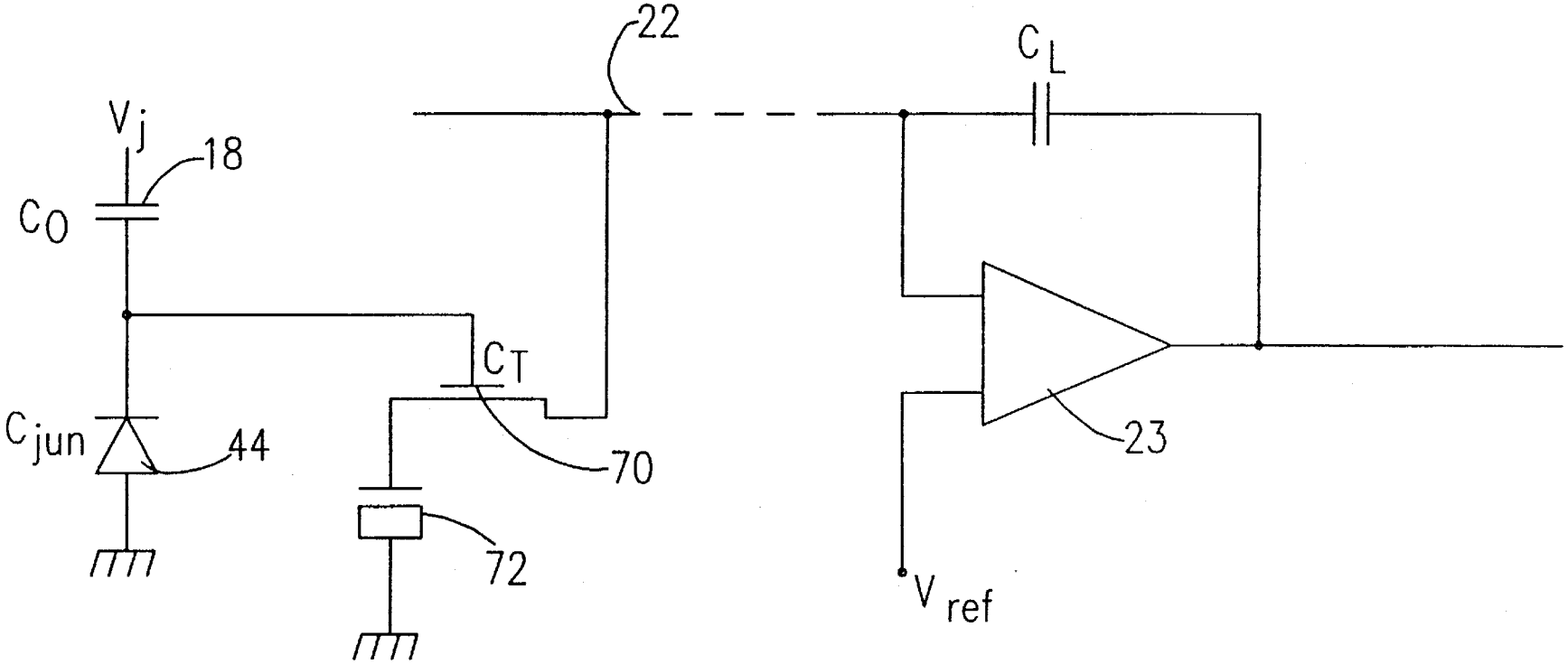
FIG. 6 is a schematic circuit diagram illustration of an alternative embodiment of the multiply unit of FIG. 3.

For example, an amplification stage based on a floating source follower, can be utilized, as shown in FIG. 6 to which reference is now made. The amplification stage typically replaces the output capacitor 20 and comprises a transistor 70, such as a Metal Oxide Semiconductor (MOS) transistor, having a threshold voltage $V_T$ and a capacitance $C_T$ similar to $C_s$, and a capacitor 72 having capacitance $C_1$ greater than $C_s$.

As explained hereinabove with reference to the previous embodiments, applying a voltage $V_j$ to the capacitor 18 creates a change delta_$V_{ij}$ in the voltage $V_{ij}$ of junction 44, as given by equations 11 and 12 and as simplified as follows:

$$delta_V_{ij}=KV_jQ_{ij} \tag{19}$$

where K is a constant.

The source potential of the transistor 70 is initially set to $V_{ij}-V_T$ such that the transistor 70 is operating in its linear, amplifying mode. When the voltage $V_j$ is applied to the capacitor 18, causing a change delta_$V_{ij}$ in the voltage of junction 44, the source potential of the transistor 70 is increased by delta_$V_{ij}$.

The amplification of the transistor 70 is determined by $C_1$, as follows: because the transistor 70 is in the linear stage, it enables current to flow from the capacitor 72 to the output sense line 22 and to the operational amplifier 23. When the source potential of the transistor increases by delta_$V_{ij}$, the capacitor 72, which has an initial voltage of $V_{ij}$, supplies charge to the output sense line 22 until voltage of capacitor 72 increases by delta_$V_{ij}$.

The presence of the transistor 70 isolates the charge flow from capacitor 72 to the output sense line 22 from the production of delta_$V_{ij}$ (i.e. the voltage delta_$V_{ii}$ does not depend on the value $C_1$). This fact, and the fact that the transistor 70 has a capacitance $C_T$ similar to $C_s$, enables the linearity requirement described hereinabove to be maintained. Thus, when $C_1$ is greater than $C_s$, the output signal of operational amplifier 23 is increased by $C_1/C_T$.

It is noted that, if the capacitors 18 and 72 are formed of gate oxide, an amplification in the range of 25 to 50 is possible for reasonably sized multiply units 10 that serve as basic building blocks in the vector-matrix multipliers 30.

It is further noted that for this alternative embodiment, step b of the loading method described hereinabove becomes:

b) The output sense line 22 is grounded in order to ensure that capacitor 72 is empty before the connection of the voltage $V_{ij}(o)$. After the connection of $V_{ij}(o)$, the voltage on capacitor 72 rises to $V_{ij}$.

It will further be appreciated by persons skilled in the art that the present invention is not limited to what has been particularly shown and described hereinabove. Rather, the scope of the present invention is defined only by the claims that follow:

We claim:

1. Apparatus for performing analog multiplication of a first value by a second value comprising:

a variable capacitor whose capacitance represents said first value;

a second value voltage receiver, serially connected to said variable capacitor, wherein said second value voltage represents said second value;

wherein a voltage level of said variable capacitor resulting from the provision of said second value voltage to said second value voltage receiver represents the multiplication of said first and second values.

2. Apparatus according to claim 1 and wherein said second value voltage receiver is a capacitor.

3. Apparatus according to claim 1 and wherein said variable capacitor comprises a reverse biased diode implemented as a pn junction.

4. Apparatus according to claim 3 and including a charge provider selectably connectable to said pn junction, whereby said charge provider provides said quantity of charge to said pn junction.

5. Apparatus according to claim 1 and wherein said variable capacitor is operative to receive a quantity of charge representing said first value.

6. Apparatus according to claim 5 and wherein said quantity of charge is directly proportional to said first value.

7. Apparatus according to claim 1 and wherein the capacitance of said variable capacitor is inversely proportional to said first value.

8. Apparatus for performing analog multiplication and addition comprising:

at least two multiplication units for multiplying a first value by a second value, each multiplication unit comprising:

a variable capacitor whose capacitance represents said first value;

a second value voltage receiver, serially connected to said variable capacitor, wherein said second value voltage represents said second value; and a sensor, having first and second ends and connected at said first end to said variable capacitor, operative to sense an output voltage change in a voltage level thereof, wherein said output voltage change of said variable capacitor resulting from the provision of said second value voltage to said second value voltage receiver represents the multiplication of said first and second values; and a summing device connecting in parallel said second ends of at least two of said sensors and operative to sum together said output voltage changes.

9. Apparatus according to claim 8 and wherein said sensor is a capacitor.

10. Apparatus according to claim 8 and wherein said sensor is a floating source follower.

11. Analog apparatus for multiplying a vector by a matrix, the analog apparatus comprising:

at least two rows of multiply units each for multiplying one row of said matrix by said vector, each multiply unit comprising:

at least two multiplication units for multiplying a matrix element by a vector element, each multiplication unit comprising:

a variable capacitor whose capacitance represents said first value;

a second value voltage receiver, serially connected to said variable capacitor, wherein said second value voltage represents said second value; and a sensor, having first and second ends and connected at said first end to said variable capacitor, operative to sense an output voltage change in a voltage level thereof, wherein said output voltage change of said variable capacitor resulting from the provision of said second value voltage to said second value voltage receiver represents the multiplication of said first and second values; and a summing device connecting in parallel said second ends of at least two of said sensors and operative to sum together said output voltage changes.

12. Apparatus for performing analog multiplication of a first value by a second value comprising:

a variable capacitor whose capacitance represents said first value;

voltage receiving means, serially connected to said variable capacitor, for receiving said second value voltage represents said second value and for providing said second value voltage to said variable capacitor;

wherein a voltage level of said variable capacitor resulting from the provision of said second value voltage to said voltage receiving means represents the multiplication of said first and second values.

13. Apparatus for performing analog multiplication and addition comprising:

at least two multiplication units for multiplying a first value by a second value, each multiplication unit comprising:

a variable capacitor whose capacitance represents said first value;

voltage receiving means, serially connected to said variable capacitor, for receiving said second value voltage represents said second value and for providing said second value voltage to said variable capacitor;

means, having first and second ends and connected at said first end to said variable capacitor, for sensing an output voltage change in a voltage level thereof, wherein said output voltage change of said variable capacitor resulting from the provision of said second value voltage to said voltage receiving means represents the multiplication of said first and second values; and a summing device for connecting in parallel said second ends of at least two of said sensors and for summing together said output voltage changes.

14. Analog apparatus for multiplying a vector by a matrix, the analog apparatus comprising:

at least two rows of multiply units each for multiplying one row of said matrix by said vector, each multiply unit comprising:

at least two multiplication units for multiplying a matrix element by a vector element, each multiplication unit comprising:

a variable capacitor whose capacitance represents said matrix element;

voltage receiving means, serially connected to said variable capacitor, for receiving a vector element voltage representing said vector element and for providing said vector element voltage to said variable capacitor; and means, having first and second ends and connected at said first end to said variable capacitor, for sensing an output voltage change in a voltage level thereof, wherein said output voltage change of said variable capacitor resulting from the provision of said vector element voltage to said voltage receiving means represents the multiplication of said matrix element by said vector element; and a summing device for connecting in parallel said second ends of at least two of said means for sensing and for summing together said output voltage changes, said sum being the multiplication of said one row of said matrix by said vector.

15. A method for performing analog multiplication of a first value by a second value, the method comprising:

providing a variable capacitor whose capacitance represents said first value:

providing a second value voltage receiver, serially connected to said variable capacitor wherein said second value voltage represents said second value: and receiving a voltage level of said variable capacitor resulting from the provision of said second value voltage to said second value voltage receiver:

wherein said voltage level of said variable capacitor represents the multiplication of said first and second values.

16. A method for performing analog multiplication of a first value by a second value, the method comprising:

providing a variable capacitor whose capacitor represents said first value:

providing voltage receiving means, serially connected to said variable capacitor, for receiving said second value voltage represents said second value and for providing said second value voltage to said variable capacitor: and receiving a voltage level of said variable capacitor resulting from the provision of said second value voltage to said voltage receiving means:

wherein said voltage level of said variable capacitor represents the multiplication of said first and second values.

* * * * *